US006560800B1

(12) United States Patent
Draves

(10) Patent No.: US 6,560,800 B1
(45) Date of Patent: May 13, 2003

(54) LUMBAR REINFORCEMENT DEVICE

(76) Inventor: Andrew Draves, 234 Daytona St., West Haven, CT (US) 06516

( * ) Notice: Subject to any disclaimer, the term of this patent is extended or adjusted under 35 U.S.C. 154(b) by 0 days.

(21) Appl. No.: 09/677,818

(22) Filed: Sep. 29, 2000

(51) Int. Cl.[7] ..... A47C 20/00
(52) U.S. Cl. ..... 5/630; 5/657; 5/632; 5/633
(58) Field of Search ..... 5/632, 630, 633, 5/424, 655, 657

(56) References Cited

U.S. PATENT DOCUMENTS

| | | | | | |
|---|---|---|---|---|---|
| 716,752 | A | * | 12/1902 | Phillips | 5/644 |
| 1,385,355 | A | | 7/1921 | Banks | |
| 2,562,725 | A | * | 7/1951 | Leto et al. | 5/631 |
| 2,800,897 | A | | 7/1957 | Ross | |
| 2,952,856 | A | * | 9/1960 | Ruff | 297/391 |
| 3,811,140 | A | | 5/1974 | Burpo | |
| 3,840,916 | A | | 10/1974 | Jennings | |
| 4,031,578 | A | | 6/1977 | Sweeney | |
| 4,054,960 | A | | 10/1977 | Pettit et al. | |
| 4,383,713 | A | | 5/1983 | Roston | |
| 4,434,513 | A | | 3/1984 | Welch | |
| 4,506,396 | A | | 3/1985 | Ritchie, Jr. et al. | |
| 4,648,142 | A | | 3/1987 | Bruning | |
| 4,984,315 | A | | 1/1991 | Ortman et al. | |
| 5,182,828 | A | | 2/1993 | Alivizatos | |
| 5,189,748 | A | | 3/1993 | Garrison et al. | |
| 5,214,814 | A | | 6/1993 | Fremita et al. | |
| 5,272,780 | A | | 12/1993 | Clute | |
| 5,347,669 | A | | 9/1994 | Neviaser et al. | |
| 5,530,974 | A | * | 7/1996 | Rains et al. | 5/630 |

* cited by examiner

*Primary Examiner*—Lynne H. Browne
*Assistant Examiner*—Frederick Conley
(74) *Attorney, Agent, or Firm*—Bachman & LaPointe, P.C.

(57) ABSTRACT

A lumbar reinforcement device for supporting the lower back of a contacting human body, including two cushionable structures connectively separated by a center structure, wherein the cushionable structures define inner spaces which hold removable inserts containing a deformably cushionable supporting material, said cushionable structures being deformable upon contact with a human body and which moldably deform to the shape of the contacting human body to provide support thereto.

10 Claims, 5 Drawing Sheets

LUMBAR REINFORCEMENT DEVICE

BACKGROUND OF THE INVENTION

The present invention relates to a lumbar reinforcement device, especially for supporting the lower back of a human body when sleeping or resting. The device includes two pillowcase like, cushionable structures connectively separated by a center structure, wherein the cushionable structures include therein removable inserts containing a deformably cushionable supporting material. The cushionable structures provide upward and lateral support to the sagging spine and tensed muscles of the lower back of a human body lying on his or her side and positioned therebetween.

Conventional lumbar supports are often cumbersome, uncomfortable, difficult to use, do not provide sufficient support to adequately stabilize and support the back of a human body or leave some areas unsupported.

Examples of prior art devices are disclosed in U.S. Pat. No. 5,182,828 to Alivizatos and U.S. Pat. No. 4,984,315 to Ortman et al. Alivizatos is a roll preventing device and is not designed for or want to provide support for the lower back.

It is, therefore, a principal objective of the present invention to provide a lumbar reinforcement device that effectively provides support for the lower back of a resting or sleeping individual.

It is a further objective of the present invention to provide a device as aforesaid which is simple and convenient to use.

It is a still further objective of the present invention to provide a device as aforesaid which is versatile and provides effective lower back support virtually independent of body size.

It is a still further objective of the present invention to provide a device as aforesaid wherein the inserts for the cushionable structures may be exchanged to provide individually designed support.

Further objects and advantages of the present invention will appear hereinbelow.

SUMMARY OF THE INVENTION

In accordance with the present invention, the foregoing objects and advantages are readily obtained.

The lumbar reinforcement device of the present invention comprises: two pillow like cushionable structures connectively separated by a center structure, wherein said cushionable structures are deformable on contact with the human body and moldably deform to the shape of said contacting human body, and wherein each of said cushionable structures define inner spaces which hold removable inserts containing a deformably cushionable supporting material, provided that when said contacting human body is disposed between said cushionable structures an upward and lateral support is provided to the back of said contacting human body. The cushionable structures are pillowcase like structures which hold removable inserts. The inserts could desirably be a pillow as a feather pillow which may be folded lengthwise in half, or an air, water, gas or plastic foam filled insert. The individual can select the insert best suitable for the particular situation.

Further features and advantages of the present invention will appear hereinbelow.

BRIEF DESCRIPTION OF THE DRAWINGS

A detailed description of preferred embodiments of the present invention follows, with reference to the attached drawings, wherein.

DETAILED DESCRIPTION OF PREFERRED EMBODIMENTS

The present invention provides a lumbar reinforcement device which comfortably supports the lumbar region of a human body, particularly the lower back. The device includes two pillowcase like structures, connected and separated by a center, sheet-like structure or field. The invention can be constructed of a single piece of sheet-like material, desirably soft and pliable. Each end of the material is folded and stitched to construct the pillowcase like structures with a field between them.

The pillowcase like structures include cushionable, removable inserts therein, as for example, feather pillows folded lengthwise in half for density and loft. Thus, when the individual lies or rests on his/her side, he/she presses his/her lower back against one cushionable pillow like structure and draws the other snuggly into his/her stomach. The body lying on top of the center structure keeps the first cushionable pillow like structure from slipping away no matter how hard the sleeper presses his/his back against it. The second cushionable pillow like structure drawn snuggly against the stomach helps keep the lumbar region pinned tightly against the first cushionable pillow like structure.

In accordance with the present invention, a lumbar reinforcement device is provided including two arcuitly shaped, cushionable structures connectively separated by a center structure, wherein said cushionable structures define inner spaces which hold removable inserts containing a deformably cushionable supporting material. The cushionable structures mold to the shape of a human body and permit the lumbar region of an individual back to be effectively and comfortably supported. The arcuitly shaped structures are desirably firm yet cushionable so as to provide comfortable support for the lumbar region of the human body, especially the lower back. In addition, the arcuitly shaped, cushionable structures are firmly connected to one another via a center structure, which may be adjustable, which permits a firm engagement of the cushionable structures with the individual.

Thus, in accordance with the present invention when an individual lying on his/her side contacts the center structure, the cushionable structures may be pulled towards the individual and positioned to the most effective location. The adjustability feature permits effective sizing.

Figure 1A:
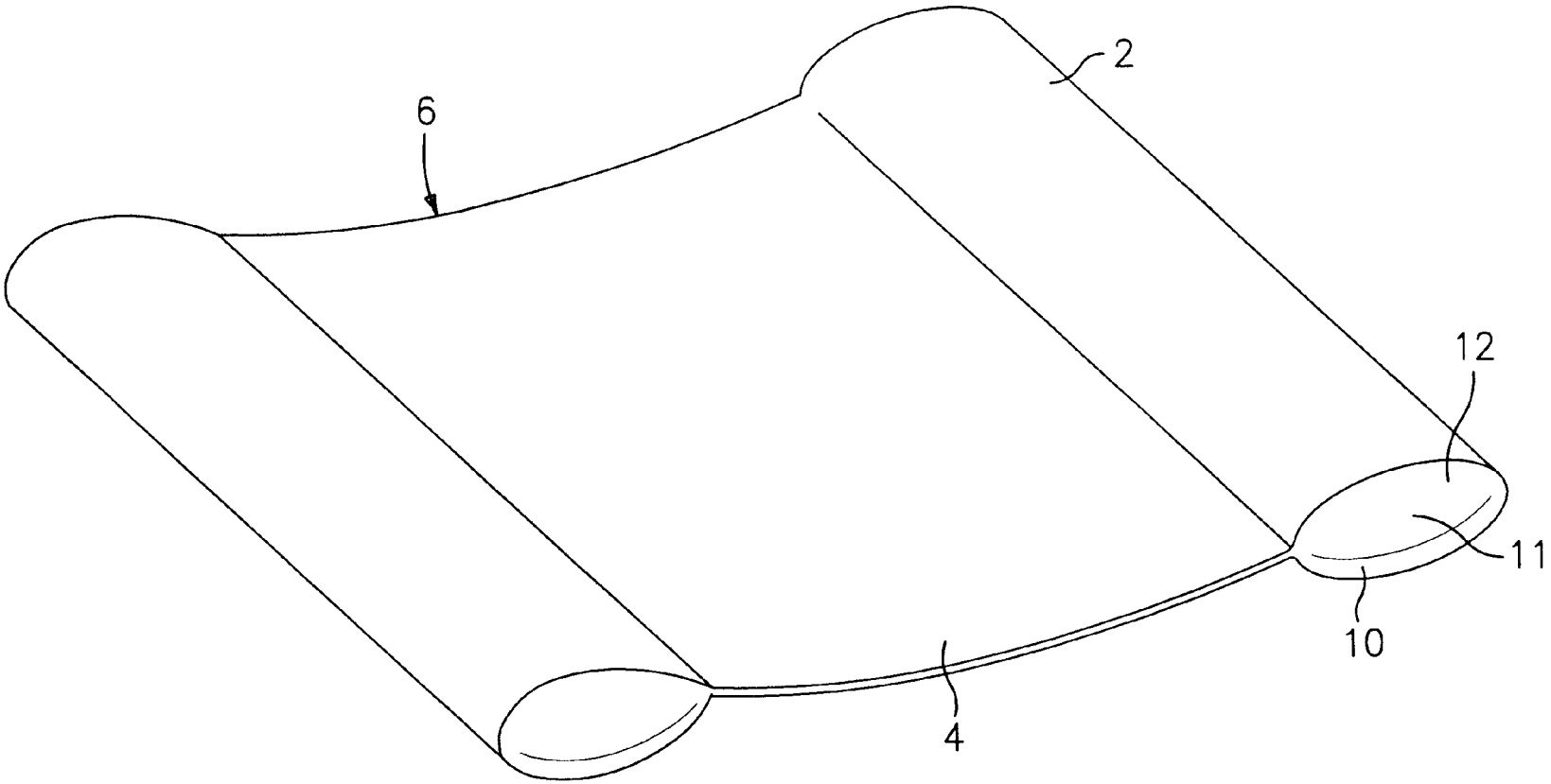
FIG. 1A is a perspective view of a lumbar reinforcement device in accordance with the present invention, showing all major components.
Figure 2:
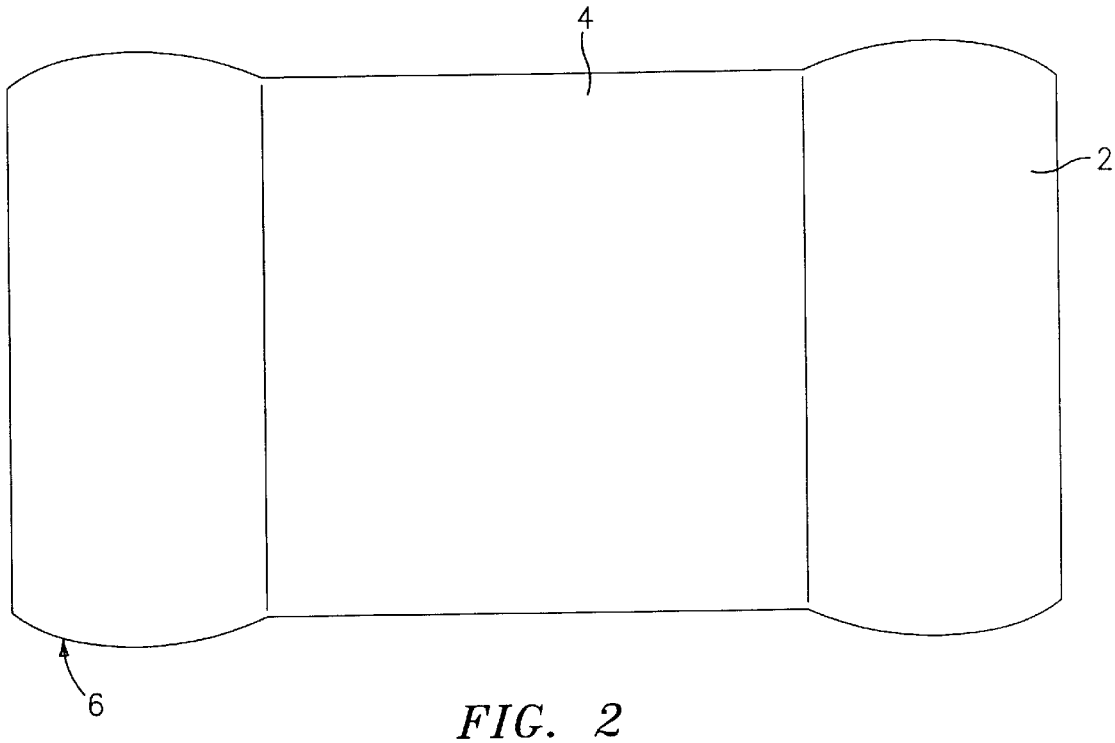
FIG. 2 is a top view of a lumbar reinforcement device in accordance with the present invention.
Figure 3:
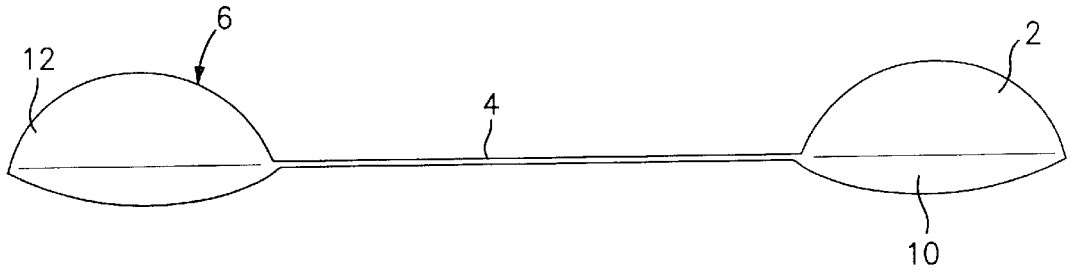
FIG. 3 is a side view of a lumbar reinforcement device in accordance with the present invention.

Referring to the drawings, FIG. 1A shows a lumbar reinforcement device 6 in accordance with the present invention including center structure 4 and two arcuitly shaped pillowcase like end structures 2 connected thereto and separated thereby. End structures 2 have an upper portion 12 and a lower portion 10 and are provided with a peripheral opening 11 for insertion therein of a cushionable insert which provides the cushionable support. Means may be provided for closing the opening if desired, as a button or tie member, or the opening 11 left open as in a pillowcase. FIG. 2 is a top view of the reinforcement device of the present invention and FIG. 3 is a side view of the device of FIG. 2.

Figure 4:
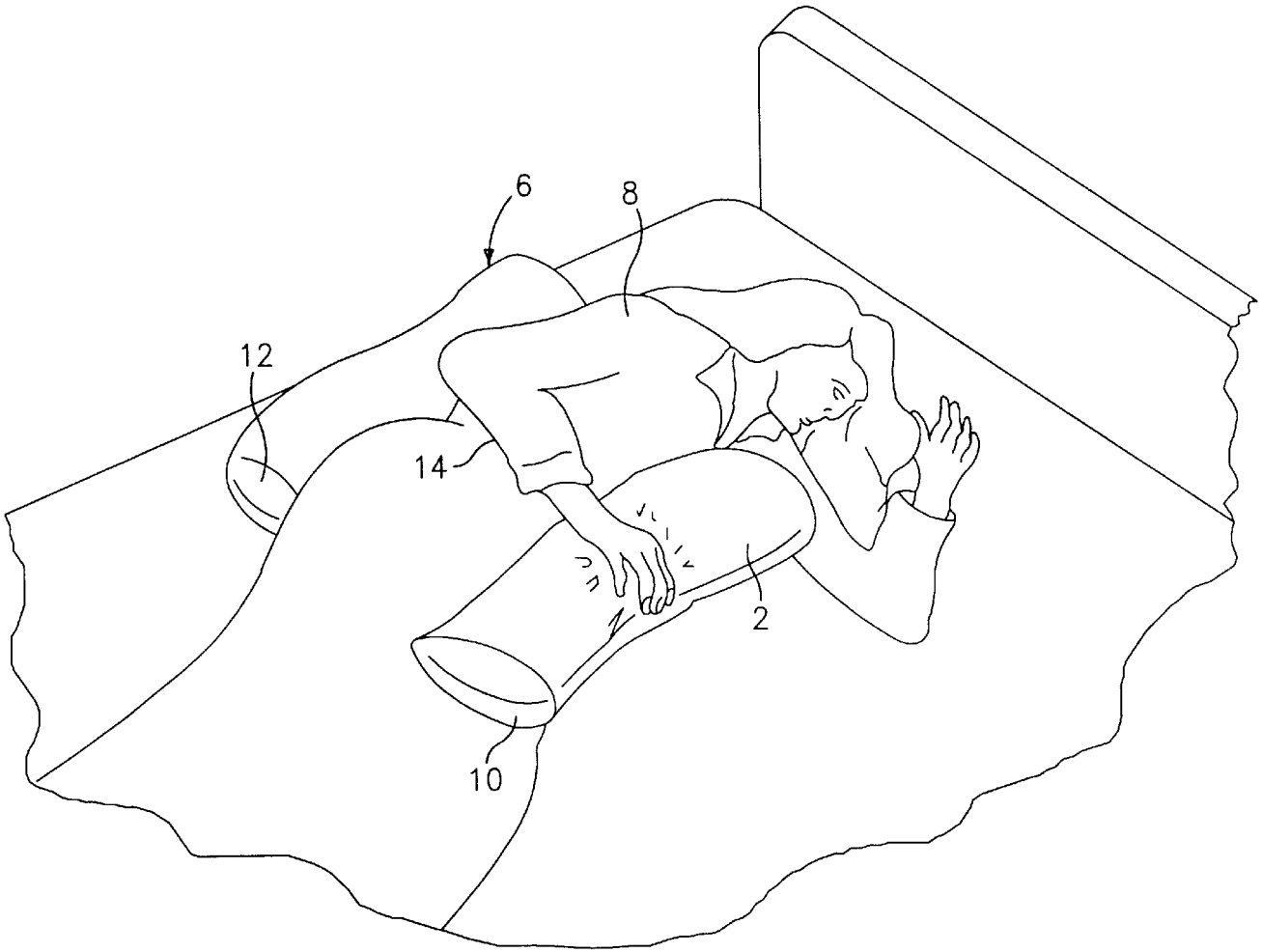
FIG. 4 illustrates a person using a lumbar reinforcement device, in accordance with the present invention.

As shown in FIG. 4, device 6 is preferably positioned on a horizontal surface, such as a bed, floor or the like and an individual 8 positioned on its side on center structure 4 between cushionable structures 2 so that the cushionable structures comfortably engage the front and back of the individual. The individual 8 desirably positions upper arm 14 over the facing cushionable structure as shown in FIG. 4, thus effectively drawing the cushionable structures closer towards the contacting individual and providing effective support for the lower back. The inserts provide the desired cushionable material and can be filled with any desired cushionable material, as for example and preferably a feather filled pillow which may be folded in half lengthwise. This will provide a sufficiently high coefficient of loft and rigidity so as to comfortably provide the desired level of support for the contacting body.

It is an advantage of the present invention that the insert may be replaceable with any desired material suitable for comfortably supporting the contacting body 8. Thus, any soft, firm, deformable and pliable cushionable material suitable for providing firm support may be used, as indicated hereinabove. It is also an advantage that the apparatus allows the sleeper to change sides during his/her rest. The cushionable pillow like structures are interchangeable as back support and stomach support.

Thus, for example, the end structures 2 may be pillowcase like in structure with one open end 11 for insertion of the insert. The structures 2 may for example be 28 inches long and ten inches wide and connected by a center structure 28 inches long and 24 inches wide. The feather pillow inserts for example may be inserted in each structure 2, desirably folded in half, or an insert having approximately the same size as structure 2 filled for example with air, water or plastic foam can be effectively used. The device is preferably used on a bed and is useful and therapeutic when the person is positioned on his or her side. The user presses his or her lower back against one cushionable structure and the other may be pulled towards the stomach to provide a comfortable fit. The downward thrust of the user against the center structure serves to hold the end structure against the back as the sleeper presses his/her back laterally against the pillow like structure. The cushionable structure against the lower back provides upward pressure to counter discomfort and sagging of the spine that occurs when one lies on one's side and also lateral pressure to relieve tension and stress in the back muscles. This is particularly useful for lower back pain.

The center structure 4 can be constructed of any suitable material, such as a cotton or felt structure normally used for bed sheets.

Figure 1B:
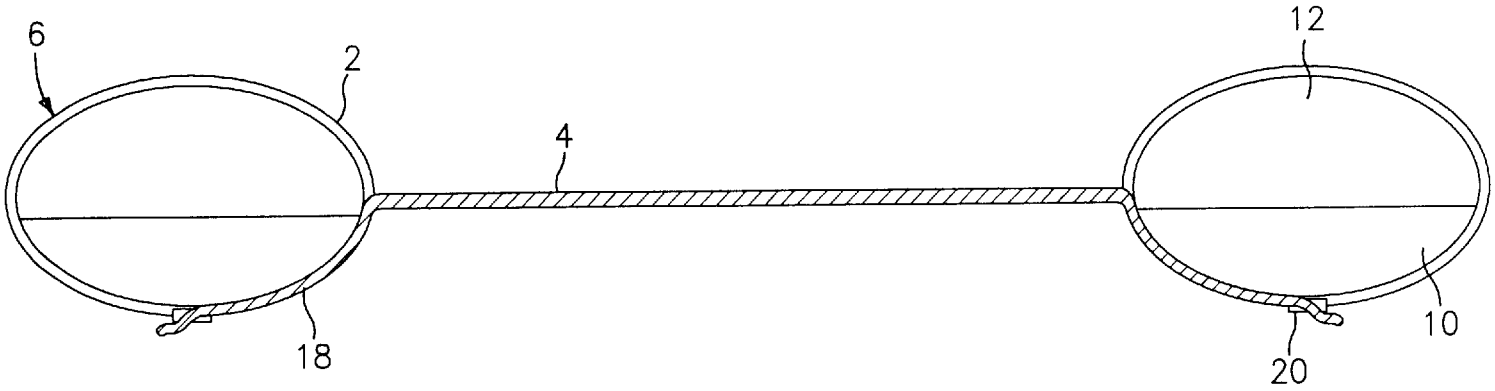
FIG. 1B is a perspective view of one embodiment of a lumbar reinforcement device in accordance with the present invention, showing an adjustable configuration with the lumbar reinforcement device adjusted to a large size.
Figure 1C:
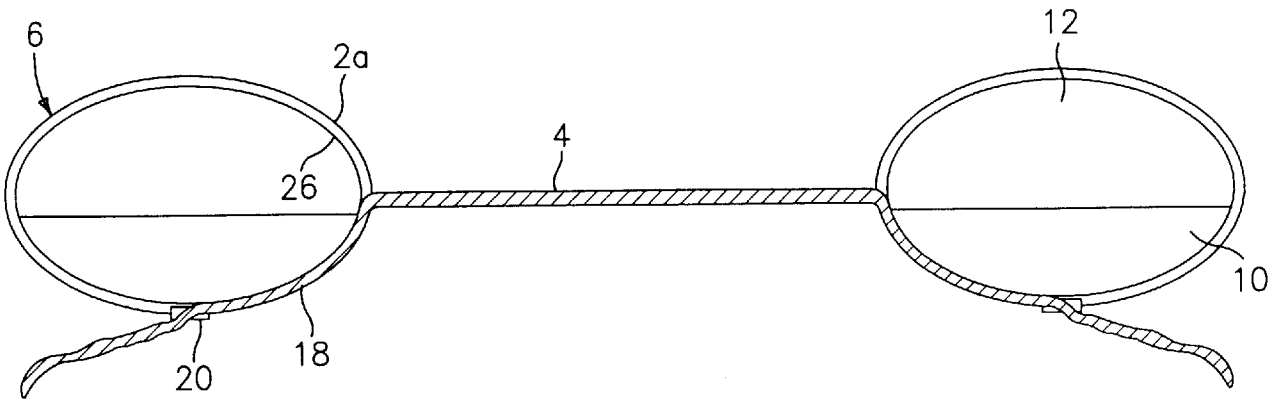
FIG. 1C is a perspective view of one embodiment of a lumbar reinforcement device in accordance with the present invention, showing an adjustable configuration with the lumbar reinforcement device adjusted to a small size.

Also, if desired, the center structure 4 can be adjustable as shown in FIGS. 1B and 1C in any convenient manner to increase or decrease the distance between the cushionable structures. For example, this may be accomplished by threading center structure 4 through sleeve 18 wherein sleeve 18 is formed between outer portion 2*a* and inner portion 2*b* of arcuitly shaped structure 2. The center structure 4 is prevented from retracting from sleeve 18 by fastener 20 which may be located on the under portion of structure 2 so as not to contact the user. The fastener 20 may for example be a Velcro attachment or any other means of preventing retraction. This will allow the user to size the device to exactly suit the needs of the user, for example, FIG. 1B shows wider spaced cushionable structures and FIG. 1C shows closer spaced cushionable structures.

Figure 5:
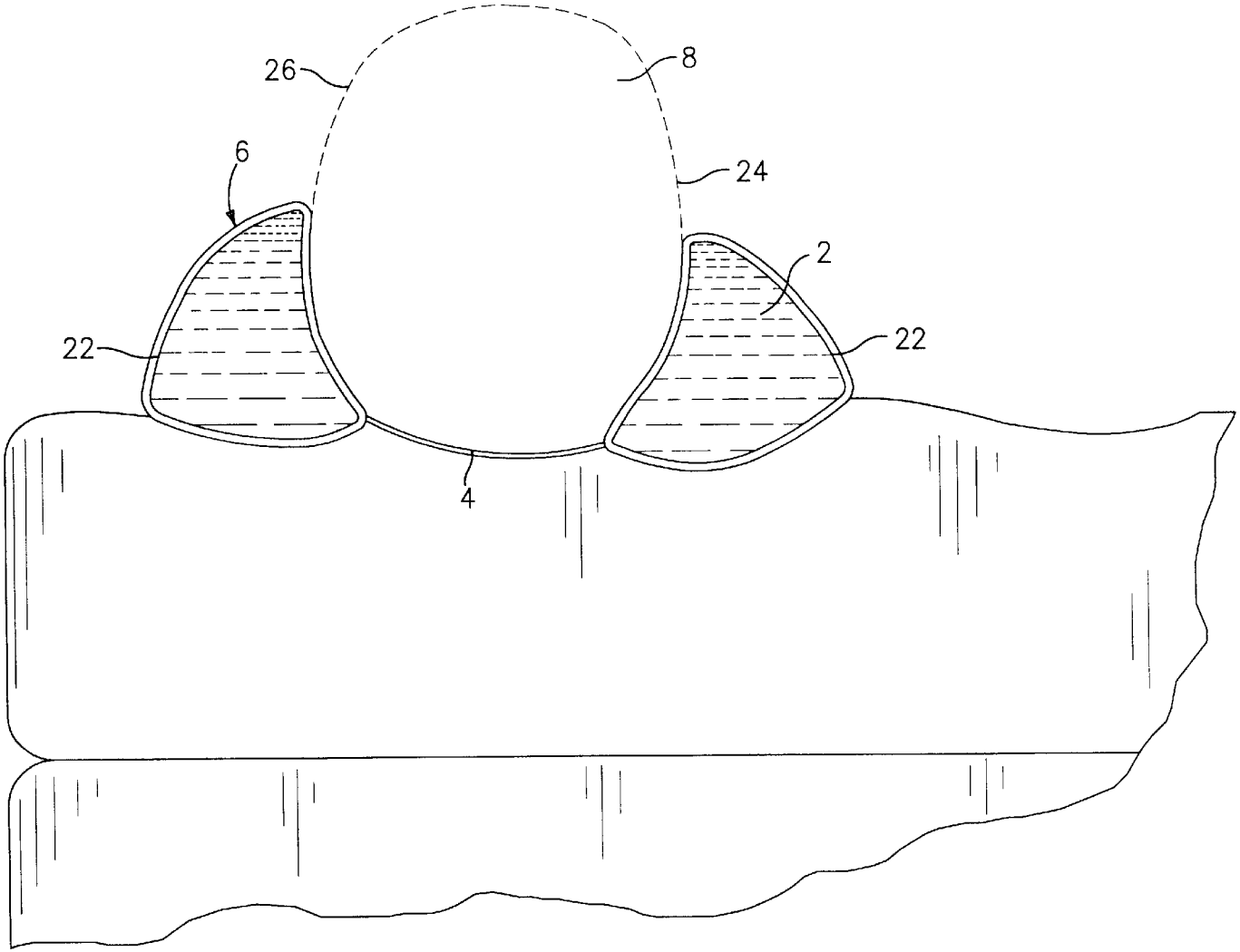
FIG. 5 is a sectional view of a person using a lumbar reinforcement device, in accordance with the present invention, showing the interaction between a human body and the lumbar reinforcement device.

FIG. 5 is a section view showing schematically an individual 8 positioned on his or her side on lumbar reinforcement device 6 of the present invention between two cushionable structures 2 and on center structure 4. Inserts 22 within structures 2, such as a feather pillow or air or water filled structures, provide the supportive, cushionable support. The individual presses one cushionable structure against his/her stomach 24 and the lower back 26 is pressed against the other. The lateral and upward thrust against the lower back comfortably eases muscle tension and counters a sagging spine.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A lumbar reinforcement device, which comprises:

two cushionable structures connectively separated by a sheet center structure, wherein said cushionable structures include end structures which hold removable inserts, and wherein said cushionable structures are deformable on contact with the human body and moldably deform to the shape of said contacting human body;

wherein each of said cushionable structures define inner spaces which hold removable inserts containing a deformably cushionable supporting material, said cushionable structures having a central portion connected to said center structure and end portions thereof beneath and above said central portion, including an opening in an end portion of each cushionable structure for receiving said inserts; and wherein the device partly envelops and supports a human body when the human body is disposed on its side between said cushionable structures, with an individual positioned on the center structure between the cushionable structures, the cushionable structures drawn closer to the individual and the cushionable structures engaging the front and lower back of the individual, provided that when said contacting human body is disposed between said cushionable structures and the back of said body engages one of said cushionable structures an upward and lateral support is provided to the back of said contacting human body;

including a sleeve forming said cushionable structures, including means for adjusting said cushionable structures so as to increase or decrease the distance therebetween, wherein said means for adjusting comprises means for adjusting the length of said center structure by moving said center structure relative to said sleeve, wherein said means for adjusting the length of the center structure includes an opening in the sleeve for threading the center structure therethrough.

2. A lumbar reinforcement device according to claim 1, wherein said inserts are pillows.

3. A lumbar reinforcement device according to claim 1, wherein said pillows are feather pillows.

4. A lumbar reinforcement device according to claim 1, wherein said inserts are filled with a deformable material selected from the group consisting of air, water, gas and plastic foam.

5. A lumbar reinforcement device according to claim 1, wherein said end structures are arcuitly shaped.

6. A lumbar reinforcement device according to claim 1, wherein said cushionable structures mold into the shape of said contacting human body, thereby supporting said contacting human body.

7. A lumbar reinforcement device according to claim 1, wherein said device provides support for the lower back of said contacting human body.

8. A lumbar reinforcement device according to claim 1, wherein said means for adjusting comprises means for adjusting the length of said center structure by moving at least one end of said center structure relative to said sleeve.

9. A lumber reinforcement device according to claim 1, wherein said cushionable structures are 28 inches long.

10. A lumbar reinforcement device according to claim 1, wherein said cushionable structures extend from the upper back of an individual, across the lower back of an individual, to a point above the top of the legs of an individual.

* * * * *